US009956975B2

(12) United States Patent
Ronse

(10) Patent No.: US 9,956,975 B2
(45) Date of Patent: May 1, 2018

(54) MONITORING SYSTEM FOR MONITORING THE AXLES OF UNPOWERED TRANSPORT UNITS

(71) Applicant: SPACE2M NV, Libin (BE)

(72) Inventor: Frederick Ronse, Duinbergen (BE)

(73) Assignee: SPACE2M NV, Libin (BE)

( * ) Notice: Subject to any disclaimer, the term of this patent is extended or adjusted under 35 U.S.C. 154(b) by 0 days. days.

(21) Appl. No.: 14/893,743

(22) PCT Filed: May 28, 2014

(86) PCT No.: PCT/EP2014/061157

§ 371 (c)(1),
(2) Date: Nov. 24, 2015

(87) PCT Pub. No.: WO2014/191508

PCT Pub. Date: Dec. 4, 2014

(65) Prior Publication Data

US 2016/0114821 A1 Apr. 28, 2016

(30) Foreign Application Priority Data

May 28, 2013 (EP) ..... 13169464

(51) Int. Cl.
*G01M 17/00* (2006.01)
*B61L 25/02* (2006.01)
(Continued)

(52) U.S. Cl.
CPC ..... *B61L 25/025* (2013.01); *B61K 9/00* (2013.01); *B61L 15/0081* (2013.01);
(Continued)

(58) Field of Classification Search
USPC ..... 701/29.1
See application file for complete search history.

(56) References Cited

U.S. PATENT DOCUMENTS 5,433,111 A 7/1995 Hershey et al.
7,392,595 B2 * 7/2008 Heimann ..... G01M 17/10 246/169 R
(Continued)

FOREIGN PATENT DOCUMENTS

DE 4408261 A1 9/1995
DE 19847291 A1 4/2000
(Continued)

OTHER PUBLICATIONS

Extended European Search Report for corresponding European Application No. 13169464.8, dated Feb. 4, 2014.
(Continued)

*Primary Examiner* — Hussein Elchanti
(74) *Attorney, Agent, or Firm* — Justin Cassell; Workman Nydegger

(57) ABSTRACT

The monitoring system comprises an axle traveled distance module connected to at least one transport unit monitoring system and adapted to determine, for each of the axle identifiers detected by at least one of the transport unit monitoring systems, an axle traveled distance increment during a corresponding acquisition time period in function of transport unit traveled distance increments during this acquisition time period of the at least one transport unit monitoring system that detected this axle identifier during this acquisition time period.

15 Claims, 3 Drawing Sheets

(51) Int. Cl.

| | |
|---|---|
| ***B61L 15/00*** | (2006.01) |
| ***B61L 25/04*** | (2006.01) |
| ***B61K 9/00*** | (2006.01) |

(52) U.S. Cl.

CPC ..... *B61L 25/026* (2013.01); *B61L 25/028* (2013.01); *B61L 25/048* (2013.01); *B61L 2205/02* (2013.01); *B61L 2205/04* (2013.01)

(56) References Cited

U.S. PATENT DOCUMENTS

| | | | | |
|---|---|---|---|---|
| 2011/0231039 | A1* | 9/2011 | Leitel | B60T 8/1893 701/19 |
| 2013/0206862 | A1* | 8/2013 | Worden | B61C 15/107 239/99 |
| 2013/0268172 | A1* | 10/2013 | Nandedkar | G06F 17/00 701/70 |
| 2014/0214248 | A1* | 7/2014 | Yamada | B60L 15/40 701/20 |

FOREIGN PATENT DOCUMENTS

| | | | |
|---|---|---|---|
| DE | 102010027490 | A1 | 1/2012 |
| EP | 1382507 | A1 | 1/2004 |
| WO | 2008079456 | A1 | 7/2008 |
| WO | 2013182887 | A2 | 12/2013 |

OTHER PUBLICATIONS

International Search Report for corresponding International PCT Application No. PCT/EP2014/061157, dated Jan. 5, 2015.

* cited by examiner

| 2 TU.ID | 62 AX.CNT |
|---|---|
| 2.1 | 2 |
| 2.2 | 2 |

| 2 TU.ID | 54 atp | 42 AX.ID | 72 | 52 Dist-inc |
|---|---|---|---|---|
| 2.1 | t1:t2 | 102,2.1.UID1 | | di1 |

| 42 AX.ID | 58 aatp | 56 Ag-dist |
|---|---|---|
| 102 | t0:t2 | ... + d1 |
| 2.1.UID1 | t0:t2 | ... + d1 |

72

MONITORING SYSTEM FOR MONITORING THE AXLES OF UNPOWERED TRANSPORT UNITS

FIELD OF THE INVENTION

The present invention generally relates to a monitoring system for monitoring the axles present beneath an unpowered transport unit, more specifically a railway wagon.

Such unpowered transport units are generally cargo or tank rail units, or other suitable railway wagons used for the carrying of cargo on a rail transport system which, when coupled together and hauled by one or more locomotives, form a train. This type of railway wagons is also referred to as goods wagons, freight wagons, freight cars, etc. These units comprise a chassis with which the unpowered transport unit is loosely laid on different stand-alone entities consisting of one axle and a pair of wheels, also referred to as wheelsets. Such a wheelset is the assembly of the wheels connected by an axle of a railway wagon rolling on the railway track. In most cases railway wagons have two bogies, each comprising two or three wheelsets. These bogies or trucks form a frame assembly beneath each end of the railway wagon which holds the wheelsets and allows for rotation around a generally vertical axis of rotation with respect to the railway wagon. However, it is possible, for example with short freight cars, to mount the wheelsets without bogies, for example two wheelsets at both ends of such a short freight car directly mounted to the railway wagon chassis. Such transport units, which are unpowered railway vehicles lack any form of on-board propulsion and often lack any form of power supply.

The present invention more specifically relates to a monitoring system for monitoring each of the axles, which also means monitoring of each of the wheelsets, present beneath an unpowered transport unit, the monitoring system being mounted on the transport unit and the monitoring system comprising a satellite positioning module in order to allow for calculation of the traveled mileage of the transport unit.

BACKGROUND OF THE INVENTION

The main cause for derailing of an unpowered rail transport unit is poor maintenance resulting in flattened wheels.

When an unpowered rail transport unit brakes, its wheels will often block when the car is still in motion. These blocked wheels will slide over the rails until the train comes to a full stop. As both the rails as well as the wheels are made out of metal, this sliding will cause the wheel to flatten on the spot where it was sliding over the rails. The result of this 'sliding and flattening' will be a wheel that is not perfectly round anymore.

A flattened wheel in a bad shape will not turn round anymore and will cause vibrations and have the risk to derail because of its 'non-adapted' form on the rails. This is why every unpowered rail transport unit wheel has to be grinded and sharpened every 100,000 km and has to be changed together with the complete axle every 1,000,000 km, because of the fact that the wheelset, this means the axle together with the 2 wheels are always made out of 1 single piece of metal.

In practice, it appears to be very difficult to register the exact mileage of the rail transport units, this because of the lack of any power supply, the extreme working conditions such as shocks, vibrations, all weather conditions, extreme temperatures, etc. and also because of the enormous logistical burden to manually keep track of this kind of data.

Even when a company would be able to calculate the traveled mileage of its unpowered rail transport units, it would be confronted with a second and even bigger problem: the differences in the track gauge in several countries or areas in the railway grid. The track gauge in Western Europe will not always be the same as the track gauge in Eastern Europe or Asia. When transporting goods by rail towards countries with a different track width, a company has 2 options:

1. transhipment of the goods to other unpowered rail transport units that are adapted to the changed gauge of the tracks; or
2. to adapt the own railcars by changing the axles.

It often happens that the train operators change the axles on unpowered rail transport units on their own initiative to prevent too many delays on the total transport. The owners of the rail transport units and or companies that lease the unpowered rail transport units are often not informed and not aware of these actions. They also often don't know which axles are being put under their wagons, and in practice often used axles are being mounted.

Due to these actions, it becomes very difficult for unpowered rail transport unit owners to keep track with the real mileage of the axles on their unpowered rail transport units.

At present, companies make rough calculations based on the dispatch planning of each of their unpowered rail transport units to have an estimate of traveled miles per transport unit, but have no clue at all about the exact mileage per axle of the wheelset.

This method however results in very large errors, but it is better than not having any idea at all.

Another method to obtain control of the need of maintenance of the wheels on an axle of an unpowered rail transport unit is to use of a time parameter instead of taking into account the mileage in case of transportation of high risk or dangerous cargo. With high risk unpowered rail transport units for instance, a monthly check is done.

This method however is not accurate at all.

Still another possibility is to mount a mechanical mileage counter on the axles.

In U.S. Pat. No. 5,433,111 for instance, an apparatus for detecting defective conditions associated with a set of railway vehicle wheels and with a rail track upon which a given railway vehicle travels comprises a rotation measurement unit for generating data indicative of motion along a vertical axis relative to the rail track.

Another comparable system is disclosed in WO 2008/079456, wherein an odometer system of the type which measures distance traversed by a railway vehicle based on a number of wheel rotations is described. The system comprises a control unit that is coupled to receive vehicle position information from a vehicle position device and one or more signals corresponding to a number of wheel rotations. The control unit is programmable to determine distance traveled by the vehicle based on position information acquired at different times. The distance information is used to provide a measure of distance traveled by the wheel during rotation.

In DE 10 2010 027 490, a system is disclosed for monitoring wear and tear of rail bound goods or passenger transport unit in a wagon. This system comprises an electronic sensor for determining a distance traveled by the car on the basis of the measured speed of the sensor. The sensor is integrated in the wheel bearing of the wagon. A speed sensor is equipped for measuring the rotating speed of the wheel bearing. A sensor electronics is connected to the speed sensor and is equipped for determining a distance traveled by the wagon based on the rotating speed measured by the speed sensor. The determined distance of the sensor electronics is compared with a certain independent distance and when there is a differential distance, slip is detected between the wheel bearing and the traffic rail. This independent distance is determined by a second satellite based measurement system.

A first big disadvantage of the systems having a mileage counter on the axles is that it is not detectable when axles are removed from beneath the wagon. It is consequently not at all possible to know the correct mileage of these axles.

Another disadvantage thereof is the need of human interaction on regular basis to check the counters of all axles and to manually put this into a database. Knowing that operators always own/operate several thousands of unpowered rail transport units and knowing that unpowered rail transport units stay out in the grid for 4 years before having to come in for inspection, this implies a gigantic manual operation that is commercially not feasible in reality.

A further monitoring system for monitoring the axles present beneath an unpowered transport unit is known from US2011/231039. It describes an embodiment which comprises a sensor device mounted on each shaft or vehicle axis of a rail vehicle. A telematics unit can be mounted on the rail vehicle and receives signals concerning start of movement, mileage, velocity, rotational direction, blockage of the wheels, brake activity etc. from each of these sensor devices via a wireless radio link. It is further acknowledged that as the individual vehicle axels can be individually replaced, they can have mileages different from the rail vehicle. The telematics unit can also examine the position of the rail vehicle by means of GPS. It is further disclosed that the sensor devices could store a unique identifier for the shaft on which they are mounted. However the sensor device requires, next to the suitable sensor systems for determining the mileage of the axle, also a radio module suitable for setting up wireless communication channel with the telematics unit in order to transmit this determined mileage from the sensor device to the telematics unit. It is clear that such a setup of the sensor device necessitates an on-board power supply in the form of battery, which leads to a the need for providing a counterweight and additional complexity as the battery needs to be replaced in a timely manner. Additionally, as the mileage of the axles is determined in the sensor device itself, the monitoring system is only able to cope with axles which are provided with such a sensor device. Especially when one or more of the wheelsets of a rail vehicle are for example replaced with wheelsets that are not equipped with such a sensor device, the system will not be able to reliably track the mileage during which such unidentified axles have been used. Additionally, replacement of one axle with another axle according to this system is not considered a dangerous situation, while, especially in the case of for example providing unidentified used axles to a rail cart comprising hazardous goods in practice does pose a risk, which would go undetected and without issuing an alert.

It is known from EP1382507 to provide a passive transponder to the axle of a wheelset of a rail vehicle comprising a unique identifier for the wheelset, which can be detected by means of a handheld detector within a distance of 2 to 4 cm. However such a passive transponder does not comprise suitable sensor systems do determine the mileage of the axles of the wheelsets.

There therefore exists a need for a monitoring system providing in a more accurate, robust and a simpler way the determination of the traveled mileage of the axles of unpowered rail transport units, which monitoring system furthermore allows to more reliably detect when one or more axles are removed from beneath the unpowered transport unit and/or to detect replacement of one or more axles, especially replacement by one or more unidentified axles.

SUMMARY OF THE INVENTION

According to a first aspect of the invention there is provided A monitoring system for monitoring the axles of at least one unpowered transport unit, the monitoring system comprising at least one transport unit monitoring system, each of the at least one transport unit monitoring systems being mounted on each of the at least one monitored transport units, the transport unit monitoring system comprising:

a satellite positioning module which is adapted to make a plurality of consecutive position measurements of the transport unit at a corresponding plurality of acquisition times;

a transport unit traveled distance module connected to said satellite positioning module and adapted to determine from said position measurements transport unit traveled distance increments during a corresponding acquisition time period for determining the total traveled distance of the transport unit, a communication module comprising a wireless identification module which is adapted to detect one or more wireless identification tags comprising an axle identifier adapted to uniquely identify an axle when coupled to this axle and present within a predetermined wireless identification module detection range, Characterised in that the monitoring system further comprises an axle traveled distance module connected with said at least one transport unit monitoring system and adapted to determine, for each of the axle identifiers detected by at least one of the transport unit monitoring systems, an axle traveled distance increment during a corresponding acquisition time period in function of said transport unit traveled distance increments during this acquisition time period of the at least one transport unit monitoring system that detected this axle identifier during this acquisition time period Example of such a satellite positioning modules are for example GPS (global positioning system) which is globally available. Other examples are GLONASS (GLObal NAvigation Satellite System) or Galileo.

Such a monitoring system is able to obtain the traveled distance of each of the axles situated beneath the transport unit in a robust and reliable way without requiring complex equipment to be mounted on these axles as only a simple wireless tag needs to be mounted to the rotating axles. All other equipment of the transport unit monitoring system such as for example the satellite positioning module and the communication module, can be mounted on the transport unit body, for example in the form of an on-board monitoring device. As the detection functionality is incorporated in the wireless identification module the wireless tag can be executed as a simple passive wireless tag such as an RFID tag which can be easily applied to the rotating axles. In this way the indirect tracking of the distance increments of each of the axles by means of the position tracking of the transport unit, reduces the complexity of the axle mounted components, while still retaining sufficient robustness and flexibility to track traveled distance increments for axles even when they are for example dismounted from one transport unit and subsequently re-used and mounted to a further transport unit.

This allows to easily follow up planning of for example maintenance operations to the unpowered rail transport units that need a grinding or sharpening of their wheels or that need a complete axle-swap. This will result in a much safer rail transport, which is especially useful in the context of railway wagons for transporting hazardous goods.

Furthermore, because of this specific setup of the detection and the unique identification of the axle(s), every single axle can be monitored even if this axle is placed beneath another transport unit, on the condition that this other transport unit is provided with a transport unit monitoring system.

Also, even if one or more non-identified axles are mounted beneath a transport unit, the monitoring system is capable of determining the traveled distance of these non-identified axles as will be explained in further detail below.

Still another advantage is that, when one or more axles are replaced, the only thing that has to be done is to install a new identification unit on the new axle(s) so that the system can start to monitor the new axle(s) and can register the exact amount of traveled miles on the newly mounted axle(s).

Furthermore, the unique identification of the axles make it easier for inspection of the unpowered rail transport units; an easier and 100% foolproof identification of the unpowered rail transport unit becomes possible.

According to an embodiment the axle traveled distance module is further configured to update for each of the detected axle identifiers an aggregated axle traveled distance during a corresponding aggregated acquisition time period by aggregating the axle traveled distance increments of all acquisition time periods comprised within this aggregated acquisition time period.

In this way a reliable tracking of the aggregated traveled distance of each individual axle is made possible, even when consecutively used in different transport units, without requiring complex equipment to be arranged on the rotating axles.

According to a further embodiment the monitoring system further comprises an axle count correlation module connected with said axle traveled distance module and configured to store for each of the at least one unpowered transport units an axle count corresponding to the predetermined plurality of axles it comprises.

This allows, without the need for operator intervention to reliably asses the number of axles which are available for every transport unit comprising a transport unit monitoring system and further increases robustness of the system for enabling for example detection of an unauthorized axle swap or for example to enable a self-check which results in a confirmed axle count for increasing the safety level as will be explained in further detail below.

According to a further embodiment the monitoring system further comprises an unidentified axle detection module connected with said axle count correlation module and configured to detect for each transport unit the presence of one or more unidentified axles when the number of detected axle identifiers by its transport unit monitoring system is lower than its axle count.

The presence of such an unidentified axle beneath for example a railway wagon transporting hazardous goods poses an increased risk, as the origin and quality of such axles cannot be reliably assessed.

According to a further embodiment the monitoring system further comprises an alert module connected to the unidentified axle detection module and configured to generate an unidentified axle alert upon detection of the presence of one or more unidentified axles by the unidentified axle detection module.

In this way suitable corrective actions can be engaged efficiently, even when the monitoring system needs to track a large number of transport units and corresponding axles. According to one example the corrective action could be sending an operator to the location of the transport unit which detected the presence of an unidentified axle for checking the origin and quality of this axle and subsequently applying a wireless tag 5 to the axle, such that from that moment on also these axles can be tracked reliably. It is clear that other corrective actions could be possible, such as for example completely replacing the wheelset with another suitably certified wheelset which is identified by means of a wireless tag, etc.

According to a further embodiment the unidentified axle detection module is further configured to generate an unique unidentified axle identifier for each of the detected unidentified axles; and in that the axle traveled distance module is further connected with said unidentified axle detection module and adapted to determine, for each of the unidentified axle identifiers, an axle traveled distance increment during a corresponding acquisition time period in function of said transport unit traveled distance increments during this acquisition time period of the at least one transport unit monitoring system correlated to this unidentified axle identifier during this acquisition time period.

This advantageous functionality allows reliable tracking for the traveled distance of one or more unidentified axles when they are mounted on a transport unit and are being used during transport, for example in a location which is too remote for immediate operator intervention, or because the risk level associated with the railway wagon allows temporary usage of unidentified axles, for example when not transporting hazardous goods in an empty state.

According to a further embodiment the axle traveled distance module is further configured to update an aggregated axle traveled distance for each of the unidentified axle identifiers during a corresponding aggregated acquisition time period by aggregating the axle traveled distance increments of all acquisition time periods comprised within this aggregated acquisition time period.

According to a further embodiment the alert module is further configured to provide an axel distance alert when the aggregated axle traveled distance exceeds a predetermined maximum distance limit.

According to a further embodiment the predetermined maximum distance limit for an unidentified axle identifier is smaller than the predetermined maximum distance limit for an axle identifier.

In this way the system ensures safety by warning when the aggregated traveled distance of an axle exceeds allowable limits According to a further embodiment predetermined wireless identification module detection range is larger than the predetermined maximum length of a transport unit and is preferably smaller than three times this maximum length.

In this way the system further increases the safety level by issuing a warning sooner for unidentified axles which pose a higher uncertainty with respect to their quality.

According to a further embodiment the axle traveled distance module is further adapted to determine, for each of the axle identifiers detected by at least one of the transport unit monitoring systems, an axle traveled distance increment during a corresponding acquisition time period in function of said transport unit traveled distance increments during this acquisition time period of the at least one transport unit monitoring system that continuously detected this axle identifier during this acquisition time period for which the corresponding transport unit traveled distance increments are larger than said wireless identification module detection range.

This further increases robustness of the system as wireless tags that temporarily pass through the detection range of a transport unit are filter out.

According to a further embodiment the monitoring system further comprises:

a plurality of transport unit monitoring systems mounted on a plurality of transport units a sequence detection module configured to determine one or more sequences of a subset of the plurality of transport units when during an acquisition time period corresponding to transport unit traveled distance increments which exceed the predetermined maximum length of a transport unit, the transport unit traveled distance increments of each of these transport units is substantially the same; and the difference between the position measurements each of the transport units of the sequence and its closest neighbouring is smaller than two times the predetermined maximum length of transport unit.

In this way advantageously the specific configuration of a plurality of connected railway wagons of a train can be easily detected.

According to a further embodiment the unidentified axle detection module is further connected to the sequence detection module and is further configured to detect for each sequence the presence of one or more unidentified axles when the number of detected axle identifiers by all transport unit monitoring systems of the sequence is lower than its sum of the axle count of all corresponding transport units.

This further increases the efficiency of the detection of unidentified axles as the knowledge of the sequence of transport units limits the amount of data to be processed to the position measurements of the transport unit monitoring systems of the transport units present in this sequence, without the need to process data of further transport unit monitoring systems of the monitoring system. In this way such an alert can be more quickly generated with a reduced need for processing power.

According to a further embodiment each of the at least one transport unit monitoring systems comprises a network interface for a satellite communication network configured to provide a connection with the axle traveled distance module; and/or in that the axle traveled distance module is at least partly comprised within each of the at least one transport unit monitoring systems.

This allows to choose a suitable balance between on the one hand minimizing functionality of the on-board monitoring device in function of increased robustness, simplicity and decreased power usage when for example only the satellite positioning module and the communication module comprises only the wireless identification module and a suitable low power network interface for a satellite communication network are present in the on-board monitoring device of the transport unit monitoring system and all other functionality is performed in a remote computing system which for example comprises a suitable database for at least partly performing the functionality of the axle traveled distance module or other suitable components of the monitoring system connected thereto. And on the other hand, decentralised off-line robustness, such that for example alerts can be generated by the on-board monitoring device itself without any delay, and even when a remote computing system is unreachable or unavailable.

According to a second aspect of the invention, there is provided a method of operating a monitoring system according to any of the preceding claims, characterised in that the method, for each of the at least one transport unit monitoring systems of the monitoring system, comprises the steps of the satellite positioning module making a plurality of consecutive position measurements of the transport unit at a corresponding plurality of acquisition times;

the transport unit traveled distance module determining from said position measurements transport unit traveled distance increments during a corresponding acquisition time period for determining the total traveled distance of the transport unit, the communication module detecting one or more wireless identification tags comprising an axle identifier adapted to uniquely identify an axle when coupled to this axle and present within a predetermined wireless identification module detection range, Characterised in that The method further comprises the steps of the axle traveled distance module determining, for each of the axle identifiers detected by at least one of the transport unit monitoring systems, an axle traveled distance increment during a corresponding acquisition time period in function of said transport unit traveled distance increments during this acquisition time period of the at least one transport unit monitoring system that detected this axle identifier during this acquisition time period.

In an advantageous embodiment, the monitoring system is adapted to alert that one or more axles have been removed.

The monitoring system therefore can be adapted to remotely alert via a satellite communication network that one or more axles have been removed.

The monitoring system therefore also can comprise a memory that is configured to store one or more alert events related to the removal of one or more of the axles.

A combination of both also is possible.

In a favourable embodiment of a monitoring system, the monitoring system according to the invention comprises a communication module that is adapted to communicate with one or more sensors that are configured for measuring critical transport data.

Examples of such critical transport data are

- temperature of the transported goods;
- environmental temperature;
- temperature inside the tank;
- pressure inside the tank;
- endured shocks of the transport unit;
- filling level of the inside of the container of the transport unit or a fuel tank (when present);
- leakage of goods;
- the opening of closure of the doors of the transport unit;
- etc.

Depending on the type of transport unit and the user, a diversity of such parameters is monitorable.

An embodiment of the monitoring system therefore can be adapted to remotely communicate via a satellite communication network the critical transport data gathered by these one or more sensors.

An embodiment of the monitoring system can furthermore also comprise a memory for storing the critical transport data gathered by these one or more sensors.

An embodiment of the monitoring system therewith can be adapted to alert that one or more critical transport data have exceeded a predefined limit.

An embodiment of the monitoring system therewith can be adapted to remotely alert via a satellite communication network that one or more critical transport data have exceeded a predefined limit.

An embodiment of the monitoring system furthermore can comprise a memory that is configured to store one or more alert events relating to the exceeding of one or more critical transport data of a predefined limit.

A combination of both also is possible.

In a preferred embodiment of the monitoring system, the one or more identification units are wireless tags. An example of such a wireless tag is an RFID (Radio Frequency Identification) tag.

In an advantageous embodiment of a monitoring system, the monitoring system is adapted to remotely communicate via a satellite communication network the traveled mileage of the transport unit.

In a favourable embodiment of a monitoring system, the monitoring system is adapted to remotely alert via a satellite communication network that the traveled mileage of the transport unit and/or one or more of the axles beneath the transport unit has exceeded a predefined mileage limit.

An embodiment of the monitoring system also can comprise a memory that is configured to store one or more alert events related to the exceeding of the traveled mileage of the transport unit and/or one or more of the axles beneath the transport unit has exceeded a predefined mileage limit.

A combination of both also is possible.

DETAILED DESCRIPTION OF EMBODIMENT(S)

Figure 1:
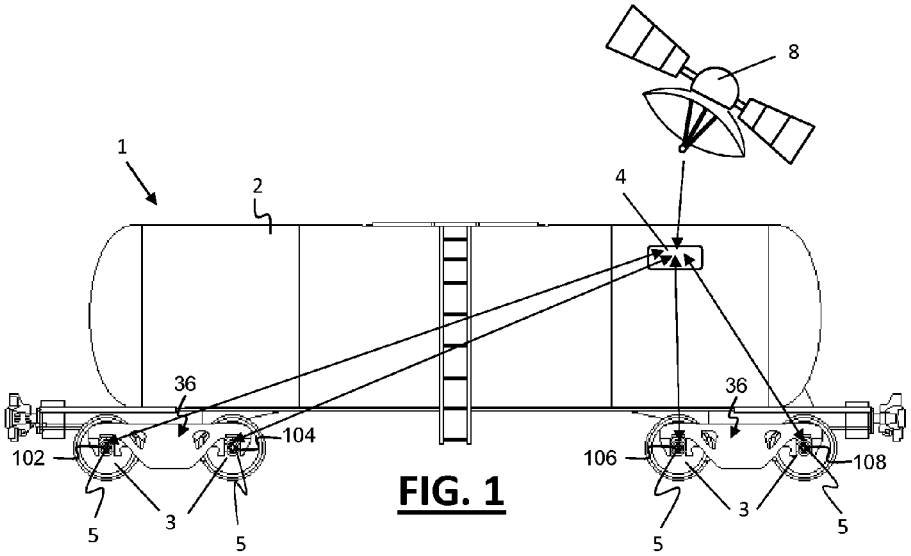
FIG. 1 illustrates a schematic side view of transport unit comprising an embodiment of the monitoring system according to the invention.
Figure 3:
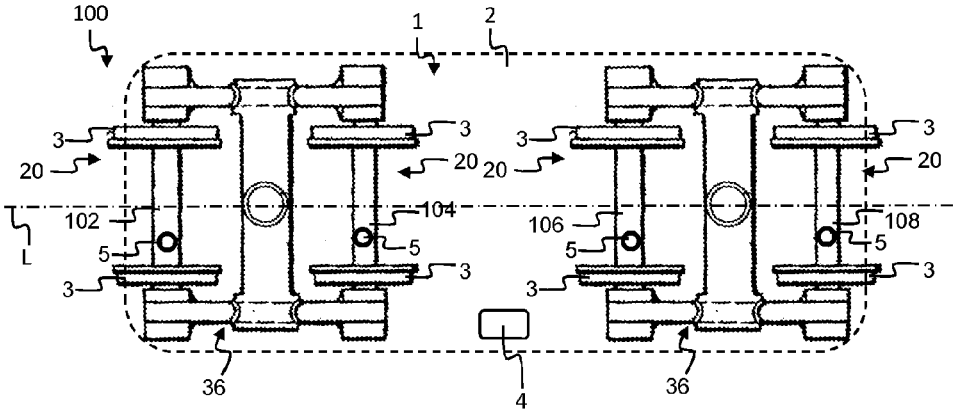
FIG. 3 schematically illustrates a top view of the transport unit of the embodiment of FIG. 1.
Figure 4:
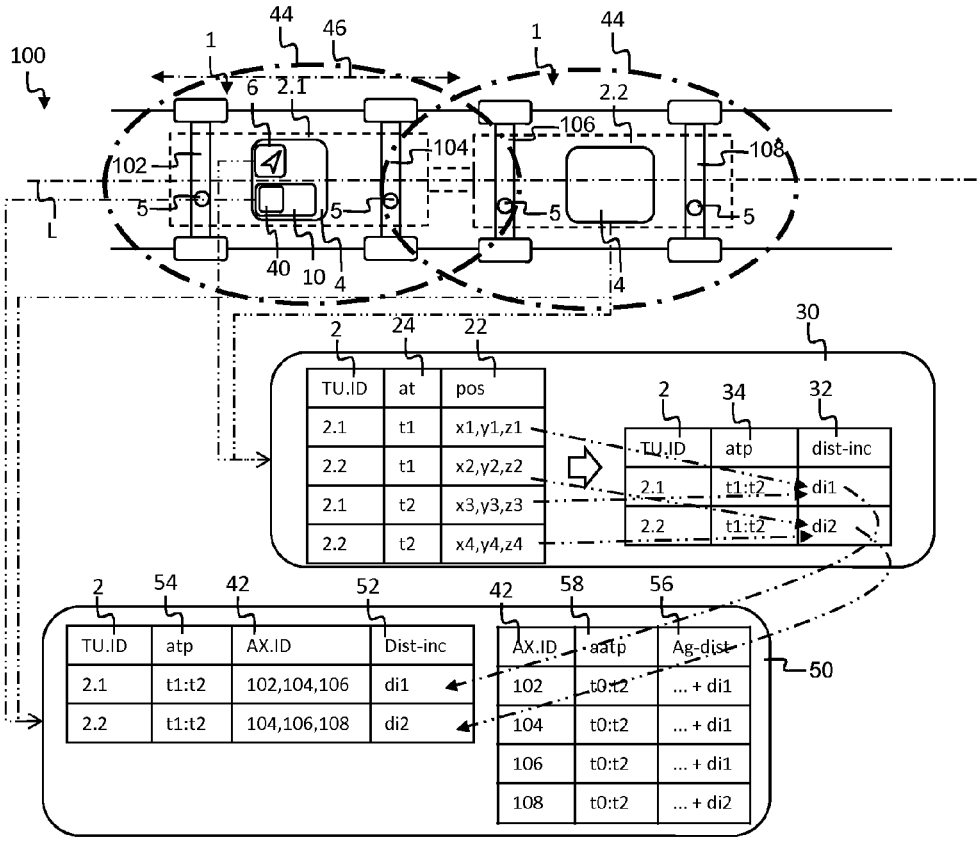
FIGS. 4 to 8 schematically illustrates a further embodiment of the monitoring system comprising a plurality of transport units.

In FIG. 1, an embodiment of the transport unit monitoring system 1 according to the invention is shown for monitoring one or more axles 102, 104, 106, 108 situated beneath an unpowered transport unit 2, such as a cargo or a tank unit, in the form of a suitable railway wagon. As shown, one axle 102, 104, 106, 108 forms one entity together with a pair of stand-alone wheels 3 placed at both ends of the respective axle, such an entity of an axle fixedly combined with both wheels, commonly referred to as a wheelset. In the context of the monitoring system 100 as will be described in further detail below it is clear that when referring to monitoring of an axel or wheelset, especially in the context of tracking the traveled distance, these terms can be used interchangeably as one revolution of the axle corresponds to one revolution of the wheelset. As shown, the embodiment of the railway wagon 2 of FIG. 1 is supported on four such axles or wheelsets, two of the axles 102, 104 are arranged in a bogie 36 at one end of the railway wagon 2 along its longitudinal axis L which substantially coincides with the driving direction, and two further axles 106, 108 are arranged in a further bogie 36 at the opposing end of the railway wagon 2. The schematic top view of the transport unit 2 of FIG. 1 as shown in FIG. 3 shows an embodiment of each of these bogies 36 in more detail in, it is however clear that numerous alternative embodiments for suitable bogies 36 are possible. As shown in FIG. 3, the transport unit 2 comprises at both ends a bogie 36, also referred to as truck, comprising a frame assembly beneath the railway wagon 2. As shown each of this bogies 36 holds two wheelsets 20, which each comprise an axle 102, 104, 106, 108 directly connected at both ends to a respective wheel 3 for rolling along a railway track. It is clear that alternative embodiments are possible in which the transport unit 2 is provided with an alternative number of wheelsets 20, for example a transport unit comprising two bogies 36, each comprising three wheelsets 20, or any other suitable arrangement and number of wheelsets 20. It is for example also possible, for example with short freight cars 2, as shown in the embodiment of FIG. 4, to mount the wheelsets 20 without bogies, for example two wheelsets 20 at both ends of such a short freight car 2 directly mounted to the railway wagon chassis.

As can be seen on FIG. 1, the transport unit monitoring system 1 preferably is housed into a housing which is mounted on the transport unit 2.

Figure 2:
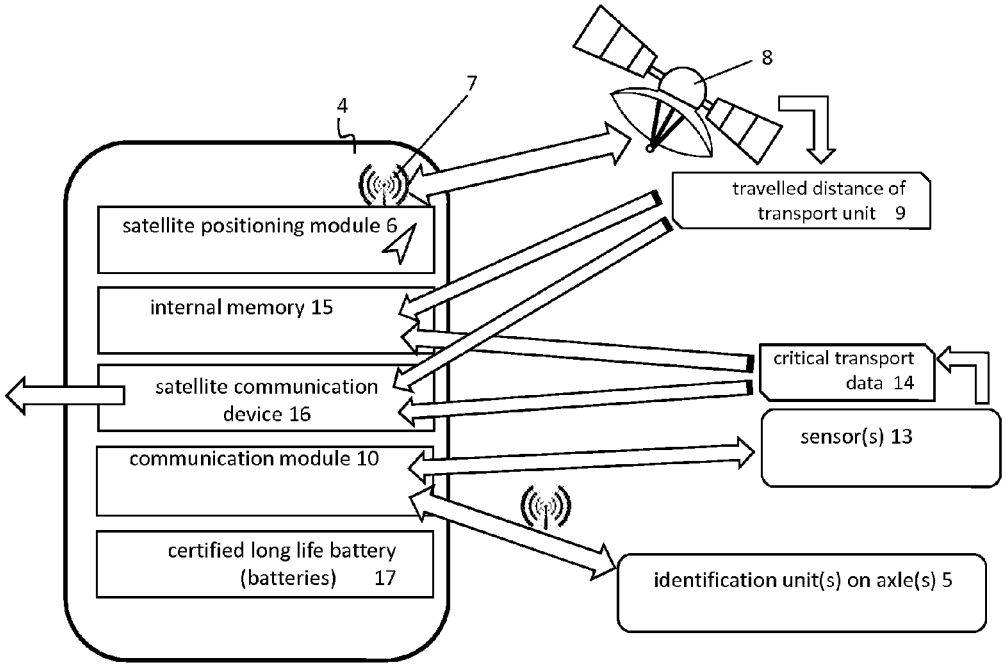
FIG. 2 illustrates a flow chart showing the different functionalities of the monitoring system according to the invention and their relationship.

As can be seen in FIG. 2, the transport unit monitoring system 1 comprises a satellite positioning module 6 comprising a receiver that via an antenna 7 is in communication with different satellites 8 of a satellite based positioning system such as for example GPS, GLONASS, Galileo, etc. and receives signals from these satellites 8 of the satellite based positioning system. The receiver which is part of the transport unit monitoring system 1 that is mounted on the transport unit 2 in this way is able to determine the position of this transport unit 2. The satellite positioning module 6 in this way is able to calculate the traveled distance of the transport unit 2 on the basis of time and the position of this transport unit 2 as will be explained in further detail below. Examples of satellite positioning systems that can be used are already listed above.

A software program that is ran on the transport unit monitoring system 1 can instruct the satellite positioning module 6 to check the location of the transport unit 2 and calculate the traveled distance 9 of the transport unit 2 at regular time intervals and store these traveled distances 9, for example in a memory 15 of the transport unit monitoring system 1. Alternatively, the software program could instruct to remotely communicate the location of the transport unit 2 at regular time intervals using a satellite communication network by means of a suitable satellite communication device 16. According to such an embodiment, the calculation of the traveled distance 9 of the transport unit 2 is then done remotely, as will be explained in further detail below. It is clear that still further alternative embodiments are possible, such as for example in which a combination of both calculation and storage is performed in the memory of the transport unit monitoring system 1 and/or remotely are possible. The choice thereof is made in function of the most optimal energy consumption and network bandwidth availability.

The transport unit monitoring system 1 can furthermore be adapted to remotely alert via a satellite communication network that the traveled distance 9 have exceeded a predefined limit, or can comprise a memory 15 for storing one or more alert events related to the exceeding of the traveled distance 9 of a predefined limit. Also a combination of both is possible.

The transport unit monitoring system 1 further comprises a communication module 10 comprising an wireless identification module 40 which is adapted to detect one or more identification units 5 that are mounted on the axles 102, 104, 106, 108. These identification units 5 are adapted to uniquely identify the axles 102, 104, 106, 108. The detection by the transport unit monitoring system 1 of the identification units 5 preferably is wireless. These identification units 5 preferably are executed as wireless tags. Preferably the identification units 5 are wireless identification tags, such as for example passive RFID tags, which are simple, cheap and robust and can be easily mounted on the axles by means of simple mounting means such as for example gluing, a suitable strap, etc. . . . . Such wireless identification tags 5, of which the functionality is preferably limited to enabling the of wireless identification module 40 to detect them in a uniquely identifiable way and can thus be executed as passive systems, comprising an low energy consumption, thus guaranteeing a long operating life even when operating from a small battery power source, or in some cases not requiring a local power source at all, which makes them extremely suitable for being mounted to the rotating axles or other suitable parts of the wheelsets as in general it is difficult to provide a suitable external energy supply to such a location which continuously rotates during use with respect to the frame of the railway wagon.

Because it is known which axles are beneath a transport unit 2, because the traveled distance of the transport unit 2 is calculated, and since there is communication between the transport unit monitoring system 1 and the identification units 5, the exact traveled distance of each of the axles can be determined.

Because of the presence of one or more identification units 5 on the axles, and because there is communication between the transport unit monitoring system 1 and these identification units 5, it is possible to alert that one or more axles have been removed from beneath a transport unit 2. The transport unit monitoring system 1 can be adapted to remotely alert via a satellite communication network that one or more axles have been removed. The transport unit monitoring system 1 can also comprise a memory 15 that is configured to store one or more alert events relating to the removal of one or more of the axles. Also a combination of both is possible.

As further shown in FIG. 2, according to this embodiment the communication module 10 of the transport unit monitoring system 1 is further adapted to communicate with one or more sensors 13 that are configured to measure critical transport data 14. According to this embodiment the communication module 10 also comprises the wireless identification module 40 that is adapted to detect the one or more identification units 5. However it is clear that according to alternative embodiments a different communication module could be provided for communication with the sensors 13. Examples of critical transport data 14 are mentioned above. The transport unit monitoring system 1 can for example be adapted to remotely communicate, via a satellite communication network by means of a suitable satellite communication device 16, the critical transport data 14 gathered by the one or more sensors 13, or, according to an alternative embodiment, can comprise a memory 15 for storing these critical transport data 14. According to still further embodiments, it is clear that also a combination of both is possible.

The transport unit monitoring system 1 can furthermore be adapted to remotely alert via a satellite communication network by means of a suitable satellite communication device 16 that one or more of the critical transport data 14 gathered by the one or more sensors 13 have exceeded a predefined limit, or, according to an alternative embodiment, can comprise a memory 15 for storing one or more alert events related to the exceeding of one or more of these critical transport data 14 of a predefined limit. According to still further embodiments, it is clear that also a combination of both is possible.

The satellite communication network for remote communication by means of the satellite communication device 16 as mentioned above preferably is a LEO Low Earth Orbit-network that in a non-directional way is responsible for global coverage. The remote communication via a satellite communication network preferably is done by means of a satellite communication device 16 that forms part of the transport unit monitoring system 1. An example of such a satellite communication device 16 is a satellite telephone, a satellite modem or any other suitable satellite telecommunication equipment. Such satellite communication technology advantageously has an extremely low energy consumption. It furthermore reduces the risk for causing an explosion even in the most extreme circumstances and it can be used in extreme temperature circumstances, i.e. between −40° C. to 85° C. It also advantageously allows for a global coverage with a worldwide reception of the signal, even in remote areas where GPRS (General Packet Radio Service) and GSM (Global System for Mobile Communications) is out of range of a terrestrial base station.

The internal memory 15, which according to the embodiment of FIG. 2, can be used for storing the traveled distance 9 of the transport unit 2, the critical transport data 14 or the alert events related to the removal of one or more axles, the exceeding of the critical transport data or the traveled distance of a predefined limit can be different or can be the same. The data 9, 14 present in the internal memory 15 can be consulted in the memory 15 itself or can be consulted at a later stage, for instance by means of USB, cable, wireless data transfer, etc.

The transport unit monitoring system 1 as described above is very versatile. It has been developed to monitor critical transport data that can vary per transport and per user.

As further shown in FIG. 2, according to this embodiment the monitoring device 4 of the transport unit monitoring system 1 preferably comprises one or more certified long-life batteries such as lithium-thionyl chloride batteries to deliver energy to this monitoring device 4. These lithium-thionyl batteries in practice have an autonomy up to 22 years. However, any other suitable batteries can be used that are certified not to emit gas, heat and current that could cause an explosion.

The transport unit monitoring system 1 as described above is very suitable to be used in the monitoring of transportation of hazardous goods by means of one or more unpowered transport units 2.

A further embodiment of the monitoring system 100 for monitoring the axles 102, 104, 106, 108 of two unpowered transport units 2.1 and 2.2. As shown these two transport units 2.1, 2.2 are connected and thus form a predetermined sequence, for example a sequence of a plurality of railway wagons that is hauled by one or more locomotives. It is clear that any other suitable plurality of transport units 2, whether these are connected in a sequence or not can form part of the monitoring system 100, as long as in general a transport unit monitoring system 1 is mounted on each of the monitored transport units 2. This means that each monitored transport unit 2 comprises its transport unit monitoring system 1 with a satellite positioning module 6 which is adapted to make a plurality of consecutive position measurements 22 of the transport unit 2 at a corresponding plurality of acquisition times 24. As shown this satellite positioning module 6 is part of an on-board monitoring device 4 of each of the transport units 2. These consecutive position measurements are then subsequently processed by means of a transport unit traveled distance module 30 connected to the satellite positioning module 6. As shown in the embodiment of FIG. 4 the transport unit traveled distance module 30 determines from these position measurements 22 transport unit traveled distance increments 32 during a corresponding acquisition time period 34. It is clear that these transport unit traveled distance increments 32 can then be used for determining the total traveled distance 9 of the transport unit 2 as will be explained in further detail below. According to the embodiment shown in FIG. 4, the each transport unit traveled distance module 30 could for example be a remotely accessible database that to which each of transport unit monitoring systems 1 of the railway wagons 2.1 and 2.2 are connected by means of a suitable network interface for a satellite communication network. However it is clear that according to alternative embodiments the transport unit traveled distance module 30 could be at least partly comprised within each of the at least one transport unit monitoring systems 1, for example in the on-board monitoring device 4 of each transport unit 2.

As further shown each transport unit monitoring systems 1 also comprises a communication module 10, for example also arranged in its on-board monitoring device 4. This communication module 10 comprises a wireless identification module 40, such as for example an RFID tag detector or any other suitable wireless tag detector that is adapted to detect one or more wireless identification tags 5, such as for example an RFID tag or any other suitable wireless tag, comprising an axle identifier 42. Such a wireless identification module 40 is thus able to uniquely identify an axle 102, 104, 106, 108 when a wireless identification tag 5 is coupled to this axle 102, 104, 106, 108 and when this wireless identification tag 5 present within a predetermined wireless identification module detection range 44, It is clear that the wireless identification tag 5 can be mounted on any suitable part of the wheelset that comprises the axle. As further shown, the monitoring system 100 further comprises an axle traveled distance module 50 connected. According to this embodiment, the axle traveled distance module 50 could for example be part of the same remotely accessible database of the transport unit traveled distance module 30, which is connected to the transport unit monitoring systems 1 of the railway wagons 2.1 and 2.2 by means of a suitable satellite communication network. However according to alternative embodiments the axle traveled distance module 50 could at least partly comprised within each of the transport unit monitoring systems 1, for example in the on-board monitoring device 4. As shown, the axle traveled distance module 50 determines, for each of the axle identifiers 42 detected by at least one of the transport unit monitoring systems 1, an axle traveled distance increment 52 during a corresponding acquisition time period 54 in function of said transport unit traveled distance increments 32 during this acquisition time period 54 of the corresponding transport unit monitoring systems 1 that detected this axle identifier 42 during this acquisition time period 54. As shown, it is clear that there can be overlap between the detection ranges 44 of the wireless identification modules 40, whereby for example both the wireless identification modules 40 track axle traveled distance increments 52 for the axles 104 and 106. When, as shown both transport units 2 are connected these distance increments will be substantially the same, however suitable ways for determining and filtering axle distance increment for axle identifiers for which a plurality of these increments are available for the same time period can be applied as will be explained in further detail below, such that overlapping detection ranges 44 of connected and/or unconnected transport units 2 can be handled reliably.

As further shown in FIG. 4, according to this embodiment the axle traveled distance module 50 further updates for each of the detected axle identifiers 102, 104, 106, 108 an aggregated axle traveled distance 56 during a corresponding aggregated acquisition time period 58 by aggregating the axle traveled distance increments 52 of all acquisition time periods 54 comprised within this aggregated acquisition time period 58. This aggregated acquisition time period 58 could for example be the time period starting at the moment when the axle was first taken in use, or starting at the moment when a suitable maintenance operation was performed on the wheelset, or any other suitable moment in time from which an aggregated acquisition time period could be tracked. It is clear that in this way the total traveled distance 9 of the transport unit 2 can thus be tracked by means this aggregated axle traveled distance 56.

Figures 5, 6, 7, 8:
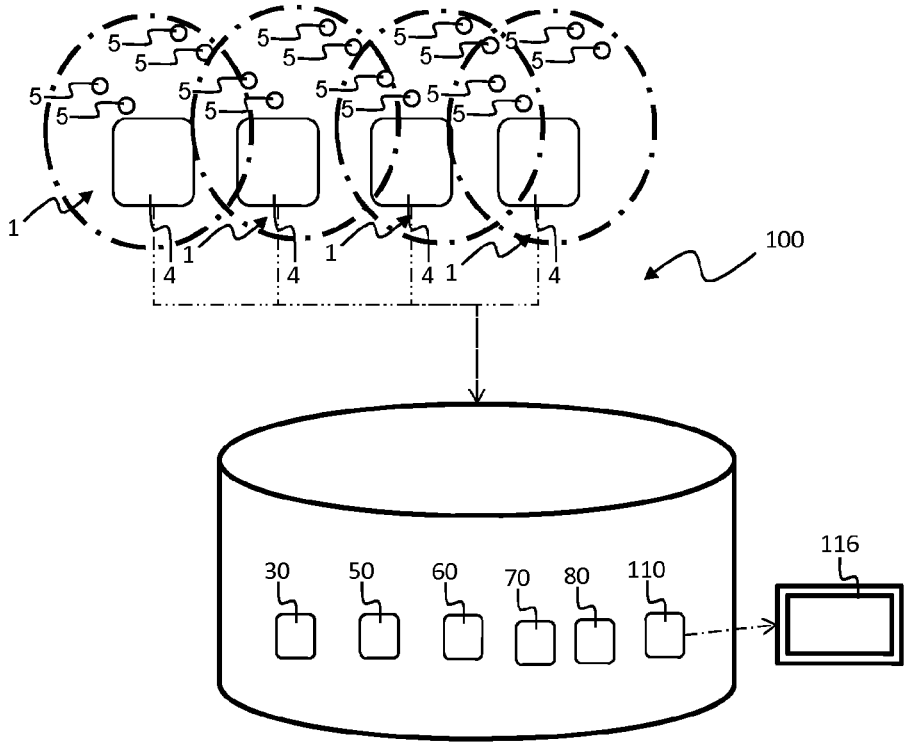

As further shown in the embodiment of FIG. 5, which shows a monitoring system 100 with a plurality of transport unit monitoring systems 1 suitably connected to a for example a central database system, comprising a transport unit traveled distance module 30 and an axle traveled distance module 50 similar as described above with reference to the embodiment of FIG. 4. As shown, monitoring system 100 further comprises an axle count correlation module 60 to store for each of the unpowered transport units 2 an axle count 62 corresponding to the predetermined plurality of axles it comprises. This increases robustness of the monitoring system 100 as detection of anomalies, such as for example unauthorized removal or replacement of a wheelset can be performed in an automated manner and operator errors in determining the number of axles assigned to a particular transport unit can be minimized. The axle count 62 could be provided for each of the of the transport unit identifiers 2 as shown in FIG. 6, however, according to alternative embodiments the axle count 62 could be set for a predetermined transport unit type and there could be provided for each transport unit identifiers a correlation with its transport unit type. It is clear that still further alternative embodiments are possible for correlating an axle count 62 to a transport unit 2.

As further shown in FIG. 5, the monitoring system 100 comprises an unidentified axle detection module 70 to detect for each transport unit 2 the presence of one or more unidentified axles. The unidentified axle detection module 70 is able to perform such a detection when the number of detected axle identifiers 42 by its transport unit monitoring system 1 is lower than its axle count 62. If for example in the embodiment shown in FIG. 4, the transport unit monitoring system 1 of the railway wagon 2.1 only detects the presence of one wireless tag 5 with an axle identifier 102, and the axle count 62 of railway wagon 2.1 is equal to two, it is clear that at least axle 104 has been replaced with an axle without a wireless tag 5. When in this example no wireless tags would be detected, as the axle count is two, it is clear that both axles 102, 104 comprise a wheelset without a wireless tag 5. As, especially in the context of for example railway wagons 2 transporting hazardous goods driving with unidentified axles of which the status, with respect to their traveled distance is uncertain is a risk which should be avoided or at least alerted. Therefor as shown the monitoring system 100 further comprises an alert module 110 connected to the unidentified axle detection module 70. This alert module 110 then generates an unidentified axle alert 116 upon detection of the presence of one or more unidentified axles by the unidentified axle detection module 70. Such an alert 116 generates for example a suitable message to an operator of the monitoring system 100, for example a message in the graphical user interface of the monitoring system or alternatively a suitable message to a communication device such as for example a telephone in the possession of the operator.

As schematically shown in FIG. 7 the unidentified axle detection module 70 generates an unique unidentified axle identifier 72 for each of the detected unidentified axles. This then allows the axle traveled distance module 50 to determine, for each of these unidentified axle identifiers 72, an axle traveled distance increment 52 in generally the same way as for the axles identified by a wireless tag 5 as described above. This means that for each of these unidentified axle identifiers 72, an axle traveled distance increment 52 is determined during a corresponding acquisition time period 54 in function of said transport unit traveled distance increments 32 during this acquisition time period 54 of the at least one transport unit monitoring system 1 correlated to this unidentified axle identifier 72 during this acquisition time period 54. Also an aggregated axle traveled distance 56 for these unidentified axle identifier 72 can be aggregated in generally the same way as explained above with reference to axles identified by a wireless tag 5 as schematically shown in FIG. 8. This means that the axle traveled distance module 50 updates an aggregated axle traveled distance 56 for each of the unidentified axle identifiers 72 during a corresponding aggregated acquisition time period 58 by aggregating the axle traveled distance increments 52 of all acquisition time periods 54 comprised within this aggregated acquisition time period 58.

Preferably the alert module 110 provides an axel distance alert when the aggregated axle traveled distance 56 exceeds a predetermined maximum distance limit, so that a timely replacement or maintenance action on the corresponding wheelset can be performed. As in general the status of identified axles can be more reliably assessed then unidentified axles it is preferred to perform maintenance or repair operations sooner on these unidentified axles, therefor according to a preferred embodiment the predetermined maximum distance limit for an unidentified axle identifier 72 is smaller than the predetermined maximum distance limit for an axle identifier 102, 104, 106, 108.

In order to reliably detect all wireless tags 5 of the axles mounted to a transport unit 2, as shown in FIG. 4 the predetermined wireless identification module detection range 44 is larger than the predetermined maximum length 46 of a transport unit 2 and is preferably smaller than three times this maximum length 46 in order not to create a too large overlap in detection of wireless tags 5 arranged on other transport units 2 present within this detection range 44 and also to minimize energy consumption of the wireless identification module 40.

In order to filter out wireless tags 5 temporary present within the detection range 44, for example of a railway wagon 2 passing by on a nearby railway track, the axle traveled distance module 50 preferably determines, for each of the axle identifiers 42 detected by at least one of the transport unit monitoring systems 1, an axle traveled distance increment 52 during a corresponding acquisition time period 54 in function of said transport unit traveled distance increments 32 during this acquisition time period 54 as explained above. However now it does this only for the at least one transport unit monitoring system 1 that continuously detected this axle identifier 42 during this acquisition time period 54 for which the corresponding transport unit traveled distance increments 32 are larger than said wireless identification module detection range 44. All axle identifiers 42 that were continuously present in the detection range 44, when such a displacement was made that exceeds the detection range 44, have executed a movement coherent with the movement of the railway wagon 2 correlated to the transport unit monitoring system 1. All other wireless tags 5, which were only temporarily detected during this movement can be filtered out.

This also allows for an embodiment in which a sequence of a plurality of connected transport units 2, such as shown in FIG. 4 can be detected. 12. As shown in FIG. 5, when there is a plurality of transport unit monitoring systems 1 mounted on a plurality of transport units 2, for example by means of their on-board monitoring device 4, as explained above, a sequence detection module 80 is able determine one or more sequences of a subset of the plurality of transport units 2 when during an acquisition time period 34 corresponding to transport unit traveled distance increments 32 which exceed the predetermined maximum length of a transport unit 2, the transport unit traveled distance increments 32 of each of these transport units 2 is substantially the same; and the difference between the position measurements 22 each of the transport units 2 of the sequence and its closest neighbouring is smaller than two times the predetermined maximum length of transport unit 2. This means that for example, when the maximum length of the transport unit 2 is for example 30 m as shown in FIG. 4, when the distance increments di1 and di2 are substantially the same for the period t1:t2 and are larger than 30 m for example 100 m, and the relative position 22 of each of the both railway wagons 2.1 and 2.2 are substantially the same at t1 and t2 and are smaller than two times 30 m, for example 35 m, then a sequence is detected. This then allows the unidentified axle detection module 70 to detect for each sequence the presence of one or more unidentified axles when the number of detected axle identifiers 42 by all transport unit monitoring systems 1 of the sequence is lower than its sum of the axle count 62 of all corresponding transport units 2.

Although the present invention has been illustrated by reference to specific embodiments, it will be apparent to those skilled in the art that the invention is not limited to the details of the foregoing illustrative embodiments, and that the present invention may be embodied with various changes and modifications without departing from the scope thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein. In other words, it is contemplated to cover any and all modifications, variations or equivalents that fall within the scope of the basic underlying principles and whose essential attributes are claimed in this patent application. It will furthermore be understood by the reader of this patent application that the words "comprising" or "comprise" do not exclude other elements or steps, that the words "a" or "an" do not exclude a plurality, and that a single element, such as a computer system, a processor, or another integrated unit may fulfil the functions of several means recited in the claims. Any reference signs in the claims shall not be construed as limiting the respective claims concerned. The terms "first", "second", third", "a", "b", "c", and the like, when used in the description or in the claims are introduced to distinguish between similar elements or steps and are not necessarily describing a sequential or chronological order. Similarly, the terms "top", "bottom", "over", "under", and the like are introduced for descriptive purposes and not necessarily to denote relative positions. It is to be understood that the terms so used are interchangeable under appropriate circumstances and embodiments of the invention are capable of operating according to the present invention in other sequences, or in orientations different from the one(s) described or illustrated above.

The invention claimed is:

1. A monitoring system for monitoring axles of at least one unpowered transport unit, the monitoring system comprising:

at least one transport unit monitoring system, wherein each of the at least one transport unit monitoring systems is directly mounted on each of the at least one monitored transport units or directly mounted to a frame or support assembly coupled to each of the at least one monitored transport units, each of the monitored transport units, the frame or support assembly being coupled to an axle to be monitored, wherein each of the at least one transport unit monitoring systems includes a satellite positioning unit including a receiver that is in communication with one or more satellites of a satellite-based positioning system, the receiver being configured to receive signals from said one or more satellites, the satellite positioning unit being configured to make and output a plurality of consecutive position measurements of the transport unit at a corresponding plurality of acquisition times;

a travelled distance calculator configured to determine from said position measurements output from said satellite positioning unit travelled distance increments of said transport unit during a corresponding acquisition time period; and a wireless identification sensor which is configured to detect one or more wireless identification tags mounted directly to one or more corresponding axles, each of the one or more wireless identification tags including an axle identifier configured to uniquely identify the corresponding axle when coupled to the corresponding axle and present within a predetermined wireless identification module detection range;

wherein the monitoring system further comprises an axle travelled-distance calculator connected with said at least one transport unit monitoring system and configured to determine, for each of the axle identifiers detected by at least one of the transport unit monitoring systems, an axle travelled distance increment during a corresponding acquisition time period in function of said transport unit travelled distance increments during the corresponding acquisition time period of the at least one transport unit monitoring system that detected the corresponding axle identifier during the corresponding acquisition time period, wherein said transport unit monitoring system is configured to update a value of said aggregated axle-travelled distance for each of the detected axle identifiers during a corresponding aggregated acquisition time period by aggregating the axle travelled-distance increments of all acquisition time periods comprised within said corresponding aggregated acquisition time period during which the axle identifier of the axle is detected, and wherein said transport unit monitoring system is configured to keep track of said value of said aggregated axle-travelled distance for each of the detected axle identifiers also when said axle is subsequently removed from said unpowered transport unit.

2. A monitoring system according to claim 1, wherein the axle travelled-distance calculator is further configured to perform said updating of said value of said aggregated axle travelled-distance for each of the detected axle identifiers during said corresponding aggregated acquisition time period.

3. A monitoring system according to claim 1, wherein the monitoring system further comprises an axle count correlator connected with said axle travelled-distance calculator and configured to store for each of the at least one unpowered transport units an axle count corresponding to the predetermined plurality of axles it comprises.

4. A monitoring system according to claim 1, wherein each of the at least one transport unit monitoring systems comprises a network interface for a satellite communication network configured to provide a connection with the axle travelled-distance calculator; and/or in that the axle travelled--distance calculator is at least partly comprised within each of the at least one transport unit monitoring systems.

5. A monitoring system for monitoring axles of at least one unpowered transport unit, the monitoring system comprising at least one transport unit monitoring system, each of the at least one transport unit monitoring systems being mounted on each of the at least one monitored transport units or mounted to a frame or support assembly coupled to each of the at least one monitored transport units, each of the monitored transport units, the frame or support assembly being coupled to an axle to be monitored, the transport unit monitoring system comprising:

a satellite positioning unit including a receiver that is in communication with one or more satellites of a satellite-based positioning system, the receiver being configured to receive signals from said one or more satellites, the satellite positioning unit being configured to make and output a plurality of consecutive position measurements of the transport unit at a corresponding plurality of acquisition times;

a travelled distance calculator configured to determine from said position measurements output from said satellite positioning unit travelled distance increments of said transport unit during a corresponding acquisition time period; and a wireless identification sensor which is adapted to detect one or more wireless identification tags comprising an axle identifier adapted to uniquely identify the axle when coupled to this axle and present within a predetermined wireless identification module detection range;

wherein the monitoring system further comprises an axle travelled-distance calculator connected with said at least one transport unit monitoring system and adapted to determine, for each of the axle identifiers detected by at least one of the transport unit monitoring systems, an axle travelled distance increment during a corresponding acquisition time period in function of said transport unit travelled distance increments during this acquisition time period of the at least one transport unit monitoring system that detected this axle identifier during this acquisition time period, wherein the monitoring system further comprises an axle count correlator connected with said axle travelled-distance calculator and configured to store for each of the at least one unpowered transport units an axle count corresponding to the predetermined plurality of axles it comprises, and wherein the monitoring system further comprises an unidentified axle detector connected with said axle count correlator and configured to detect for each transport unit the presence of one or more unidentified axles when the number of detected axle identifiers by its transport unit monitoring system is lower than its axle count.

6. A monitoring system according to claim 5, wherein the monitoring system further comprises an alerting unit connected to the unidentified axle detector and configured to generate an unidentified axle alert upon detection of the presence of one or more unidentified axles by the unidentified axle detector.

7. A monitoring system according to claim 6, wherein the unidentified axle detector is further configured to generate an unique unidentified axle identifier for each of the detected unidentified axles and in that the axle travelled distance calculator is further connected with said unidentified axle detection module and adapted to determine, for each of the unidentified axle identifiers, an axle travelled-distance increment during a corresponding acquisition time period in function of said transport unit travelled-distance increments during this acquisition time period of the at least one transport unit monitoring system correlated to this unidentified axle identifier during this acquisition time period.

8. A monitoring system according to claim 7, wherein the axle travelled-distance calculator is further configured to update an aggregated axle travelled-distance for each of the unidentified axle identifiers during a corresponding aggregated acquisition time period by aggregating the axle travelled-distance increments of all acquisition time periods comprised within this aggregated acquisition time period.

9. A monitoring system according to claim 8, wherein the alerting unit is further configured to provide an axle distance alert when the aggregated axle travelled-distance exceeds a predetermined maximum distance limit.

10. A monitoring system according to claim 9, wherein the predetermined maximum distance limit for an unidentified axle identifier is smaller than the predetermined maximum distance limit for an axle identifier.

11. A monitoring system for monitoring axles of at least one unpowered transport unit, the monitoring system comprising at least one transport unit monitoring system, each of the at least one transport unit monitoring systems being mounted on each of the at least one monitored transport units or mounted to a frame or support assembly coupled to each of the at least one monitored transport units, each of the monitored transport units, the frame or support assembly being coupled to an axle to be monitored, the transport unit monitoring system comprising:

a satellite positioning unit including a receiver that is in communication with one or more satellites of a satellite-based positioning system, the receiver being configured to receive signals from said one or more satellites, the satellite positioning unit being configured to make and output a plurality of consecutive position measurements of the transport unit at a corresponding plurality of acquisition times;

a travelled distance calculator configured to determine from said position measurements output from said satellite positioning unit travelled distance increments of said transport unit during a corresponding acquisition time period; and a wireless identification sensor which is adapted to detect one or more wireless identification tags comprising an axle identifier adapted to uniquely identify the axle when coupled to this axle and present within a predetermined wireless identification module detection range;

wherein the monitoring system further comprises an axle travelled-distance calculator connected with said at least one transport unit monitoring system and adapted to determine, for each of the axle identifiers detected by at least one of the transport unit monitoring systems, an axle travelled distance increment during a corresponding acquisition time period in function of said transport unit travelled distance increments during this acquisition time period of the at least one transport unit monitoring system that detected this axle identifier during this acquisition time period, and wherein the predetermined wireless identification module detection range is larger than the predetermined maximum length of a transport unit and is smaller than three times this maximum length.

12. A monitoring system according to claim 11, wherein the axle travelled-distance calculator is further adapted to determine, for each of the axle identifiers detected by at least one of the transport unit monitoring systems, an axle travelled-distance increment during a corresponding acquisition time period in function of said transport unit travelled-distance increments during this acquisition time period of the at least one transport unit monitoring system that continuously detected this axle identifier during this acquisition time period for which the corresponding transport unit travelled-distance increments are larger than said wireless identification module detection range.

13. A monitoring system according to claim 12, wherein the monitoring system further comprises:

a plurality of transport unit monitoring systems mounted on a plurality of transport units;

a sequence detector configured to determine one or more sequences of a subset of the plurality of transport units when during an acquisition time period corresponding to transport unit travelled-distance increments which exceed the predetermined maximum length of a transport unit, the transport unit travelled-distance increments of each of these transport units is substantially the same; and the difference between the position measurements each of the transport units of the sequence and its closest neighbouring is smaller than two times the predetermined maximum length of transport unit.

14. A monitoring system according to claim 13, wherein unidentified axle detector is further connected to the sequence detector and is further configured to detect for each sequence the presence of one or more unidentified axles when the number of detected axle identifiers by all transport unit monitoring systems of the sequence is lower than its sum of the axle count of all corresponding transport units.

15. A method for monitoring axles of at least one unpowered transport unit using a monitoring system, the monitoring system including at least one transport unit monitoring system, each of the at least one transport unit monitoring systems being mounted on each of the at least one monitored transport units or mounted to a frame or support assembly coupled to each of the at least one monitored transport units, each of the monitored transport units, the frame or support assembly being coupled to an axle to be monitored, the transport unit monitoring system including a satellite positioning unit including a receiver that is in communication with one or more satellites of a satellite-based positioning system, the receiver being configured to receive signals from said one or more satellites, the satellite positioning unit being configured to make and output a plurality of consecutive position measurements of the transport unit at a corresponding plurality of acquisition times;

a travelled distance calculator configured to determine from said position measurements output from said satellite positioning unit travelled distance increments of said transport unit during a corresponding acquisition time period; and a wireless identification sensor which is adapted to detect one or more wireless identification tags comprising an axle identifier adapted to uniquely identify the axle when coupled to this axle and present within a predetermined wireless identification module detection range;

wherein the monitoring system further comprises an axle travelled-distance calculator connected with said at least one transport unit monitoring system and adapted to determine, for each of the axle identifiers detected by at least one of the transport unit monitoring systems, an axle travelled distance increment during a corresponding acquisition time period in function of said transport unit travelled distance increments during this acquisition time period of the at least one transport unit monitoring system that detected this axle identifier during this acquisition time period, the method comprising, for each of the at least one transport unit monitoring systems of the monitoring system, the steps of:

making, by the satellite positioning unit, a plurality of consecutive position measurements of the transport unit at a corresponding plurality of acquisition times;

determining, by the travelled-distance calculator, from said position measurements transport unit travelled-distance increments during a corresponding acquisition time period for determining the total travelled-distance of the transport unit;

detecting, by the wireless identification sensor, one or more wireless identification tags comprising an axle identifier adapted to uniquely identify an axle when coupled to this axle and present within a predetermined wireless identification module detection range; and determining, by the axle travelled-distance calculator, for each of the axle identifiers detected by at least one of the transport unit monitoring systems, an axle travelled-distance increment during a corresponding acquisition time period in function of said transport unit travelled distance increments during this acquisition time period of the at least one transport unit monitoring system that detected this axle identifier during this acquisition time period.

* * * * *